US008636238B2

(12) United States Patent
Dallimore et al.

(10) Patent No.: US 8,636,238 B2
(45) Date of Patent: Jan. 28, 2014

(54) DISTRIBUTOR PLATE LOCKING MECHANISM FOR VERTICAL SHAFT IMPACT CRUSHER

(75) Inventors: Rowan Dallimore, Peasedown St. John (GB); Knut Kjaerran, Svedala (SE)

(73) Assignee: Sandvik Intellectual Property AB, Sandviken (SE)

( * ) Notice: Subject to any disclaimer, the term of this patent is extended or adjusted under 35 U.S.C. 154(b) by 198 days.

(21) Appl. No.: 12/805,415

(22) Filed: Jul. 29, 2010

(65) Prior Publication Data

US 2011/0101142 A1 May 5, 2011

(51) Int. Cl.
*B02C 19/00* (2006.01)

(52) U.S. Cl.
USPC ..... 241/275; 29/428

(58) Field of Classification Search
USPC ..... 241/275; 29/428, 700
See application file for complete search history.

(56) References Cited

U.S. PATENT DOCUMENTS 1,458,315 A * 6/1923 Babcock ..... 83/404.2
1,931,640 A * 10/1933 Baumbach ..... 82/142

FOREIGN PATENT DOCUMENTS

| | | |
|---|---|---|
| EP | 1025906 | 8/2000 |
| SE | 531087 | 12/2008 |
| SE | 531538 | 5/2009 |
| WO | 2004/020101 | 3/2004 |
| WO | 2008/147274 | 12/2008 |

OTHER PUBLICATIONS

Search Report dated Jul. 8, 2010 for International Application No. PCT/SE2010/050686 filed Jun. 18, 2010.

* cited by examiner

*Primary Examiner* — Mark Rosenbaum
(74) *Attorney, Agent, or Firm* — Morgan, Lewis & Bockius LLP

(57) ABSTRACT

A replaceable distributor plate, adapted for protecting a lower horizontal disc of a rotor of a vertical shaft impact crusher, includes a first portion of a bayonet joint, the first portion being adapted for cooperating with a second portion of the bayonet joint, the second portion being associated with the lower horizontal disc.

9 Claims, 7 Drawing Sheets

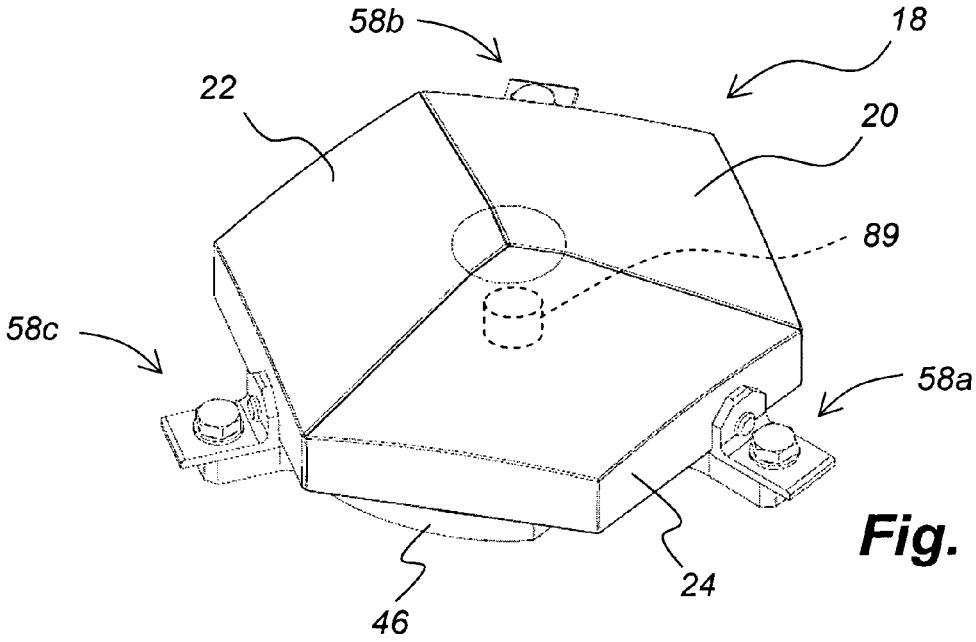
Fig. 7a
Fig. 7b
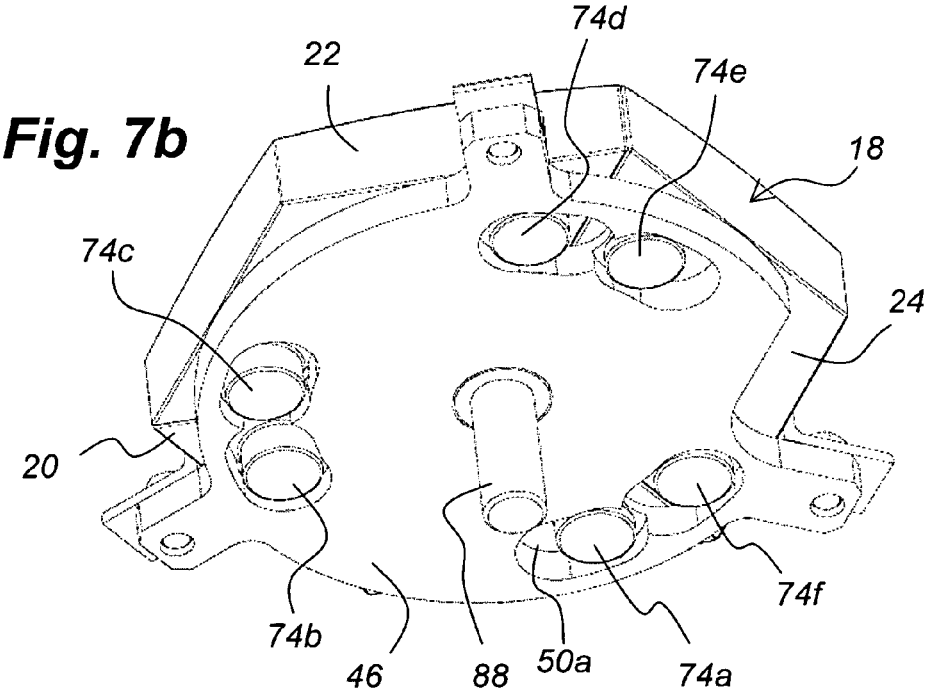

DISTRIBUTOR PLATE LOCKING MECHANISM FOR VERTICAL SHAFT IMPACT CRUSHER

CROSS-REFERENCE TO PRIOR APPLICATION

This application claims priority to Sweden Application No. 0950615-5 filed Aug. 26, 2009, which is incorporated by reference herein.

FIELD OF THE INVENTION

The present invention relates to a replaceable distributor plate adapted for protecting a lower horizontal disc of a rotor of a vertical shaft impact crusher. The present invention also relates to a support plate for a distributor plate, and to a method of mounting a replaceable distributor plate on a lower horizontal disc of a rotor of a vertical shaft impact crusher for protecting the lower horizontal disc.

BACKGROUND OF THE INVENTION

Vertical shaft impact crushers (VSI-crushers) are used in many applications for crushing hard material, such as rocks, ore, etc.

WO 2008/147274 describes one example of such a VSI-crusher. A VSI-crusher includes a housing and a horizontal rotor located inside the housing. Material that is to be crushed is fed into the rotor via an opening in the top thereof. With the aid of centrifugal force, the rotating rotor ejects the material against the wall of the housing. On impact with the wall of the housing, the material is crushed to a desired size. The housing wall could be provided with anvils or have a bed of retained material against which the accelerated material is crushed.

The rotor of a VSI-crusher usually has a horizontal upper disc and a horizontal lower disc. The upper and lower discs are connected with a vertical rotor wall. The upper disc has an aperture for feeding material into the rotor. The material lands on the lower disc and is then thrown out of the rotor via openings in the rotor wall. A replaceable center distributor plate is mounted on the horizontal lower disc to protect the same from the material fed to the rotor. The center distributor plate is in some crushing processes subjected to heavy wear, resulting in a need for frequently replacing a worn and/or damaged distributor plate, a task that is complicated and time consuming.

SUMMARY

It is an object of the present invention to solve, or at least mitigate, parts or all of the above mentioned problems. To this end, there is provided a replaceable distributor plate adapted for protecting a lower horizontal disc of a rotor of a vertical shaft impact crusher, wherein the distributor plate comprises a first portion of a bayonet joint, the first portion being adapted for cooperating with a second portion of the bayonet joint, the second portion being associated with the lower horizontal disc. A bayonet joint includes two portions, which may be joined by merely bringing the two portions together, and thereafter twisting them only a fraction of a complete turn relative to one another until they reach a limit position. An advantage of using a distributor plate of this type is that it can be replaced swiftly and with little effort.

Preferably, the first portion of the bayonet joint is adapted to be twisted in a join direction that is opposite to a crushing operation rotation direction of the rotor. In this manner, the friction force resulting from rocks falling into the rotor and onto the distributor plate will act in the same direction as the twisting direction for joining the bayonet joint, which will assist in keeping the bayonet joint locked during operation of the crusher.

In a preferred embodiment, the first portion of the bayonet joint is located on a bottom surface of the distributor plate. Because of this location of the bayonet joint, the distributor plate offers a longer service life than distributor plates of the prior art, since the distributor plate tolerates much wear before the joint between the rotor and the distributor plate will be exposed to impact and wear from falling rocks.

In one embodiment, the first portion of the bayonet joint is a foot, an upper engagement surface of the foot being adapted to engage with a lower engagement surface associated with the lower horizontal disc. This design allows for locating the greater part of the bayonet joint below the bottom surface of the distributor plate, which permits more wear to the distributor plate, and hence longer replacement intervals.

In an embodiment in which the distributor plate comprises several separate pieces, for example two to six separate pieces, more preferably three to six separate pieces, each piece comprises a first portion of a bayonet joint. Such a design provides for a secure fastening of each of the separate pieces, such that the integrity of the distributor plate is not jeopardized. By dividing the distributor plate into several pieces it becomes easier to mount the distributor plate in the rotor, both for the reason of each piece being much lighter, compared to a complete distributor plate, and for the reason of each piece being less voluminous than a complete distributor plate.

In one embodiment, the distributor plate comprises a recess for receiving a central alignment support. The recess makes it possible to align and support the distributor plate with respect to an alignment and support protrusion associated with the lower horizontal disc of the rotor. This configuration gives additional lateral stability to the distributor plate, which is of particular value for multi-part distributor plates.

According to another aspect of the invention, there is provided a support plate for supporting a replaceable distributor plate, the support plate comprising a second portion of a bayonet joint, the second portion being adapted for cooperating with a first portion of the bayonet joint, the first portion being associated with a replaceable distributor plate.

In a preferred embodiment, the second portion of the bayonet joint comprises a hole through the support plate, and a countersunk lower engagement surface adjacent the hole. Such a support plate is relatively simple and inexpensive to fabricate, and can receive the first portion of the bayonet joint without exposing any parts thereof to wear from above.

According to yet another aspect of the invention, there is provided a method of mounting a replaceable distributor plate-on a lower horizontal disc of a rotor of a vertical shaft impact crusher for protecting the lower horizontal disc, the method comprising vertically moving the distributor plate in place, and thereafter twisting the distributor plate to a limit position. This method has the advantage that it allows a very rapid distributor plate replacement. The method may also be performed without any special tools specifically adapted for the purpose, and without any particular fastening parts, such as nuts or bolts, thereby reducing the cost and effort associated with inventory management.

According to still another aspect of the invention, there is provided a vertical shaft impact crusher comprising a rotor, which comprises a distributor plate or a support plate according to the teachings above. A crusher of this type is easier to maintain than those of the prior art.

These and other aspects of the invention will be apparent from and elucidated with reference to the claims and the embodiments described hereafter.

In one aspect of the invention, there is provided a replaceable distributor plate adapted for protecting a lower horizontal disc of a rotor of a vertical shaft impact crusher comprising a first portion of a bayonet joint, said first portion being adapted for cooperating with a second portion of said bayonet joint, said second portion being associated with the lower horizontal disc.

In another aspect of the invention, there is provided a support plate for supporting a replaceable distributor plate comprising a second portion of a bayonet joint, said second portion being adapted for cooperating with a first portion of said bayonet joint, said first portion being associated with a replaceable distributor plate.

In still another aspect of the invention, there is provided a method of mounting a replaceable distributor plate on a lower horizontal disc of a rotor of a vertical shaft impact crusher for protecting said lower horizontal disc comprising vertically moving the distributor plate in place and twisting the distributor plate to a limit position.

In still yet another aspect of the invention, there is provided a vertical shaft impact crusher comprising a rotor having an upper horizontal disc and a lower horizontal disc, said rotor including a distributor plate including a first portion of a bayonet joint, said first portion being adapted for cooperating with a second portion of said bayonet joint, said second portion being associated with the lower horizontal disc.

BRIEF DESCRIPTION OF THE DRAWINGS

The invention will hereafter be described in more detail and with reference to the appended drawings.

FIG. 7*a* is a three-dimensional view in perspective of a complete distributor plate mounted on a support plate, as seen from above.

FIG. 7*b* is a three-dimensional view in perspective of the complete distributor plate mounted on a support plate, as seen from below.

DETAILED DESCRIPTION OF THE PREFERRED EMBODIMENTS

Figure 1:
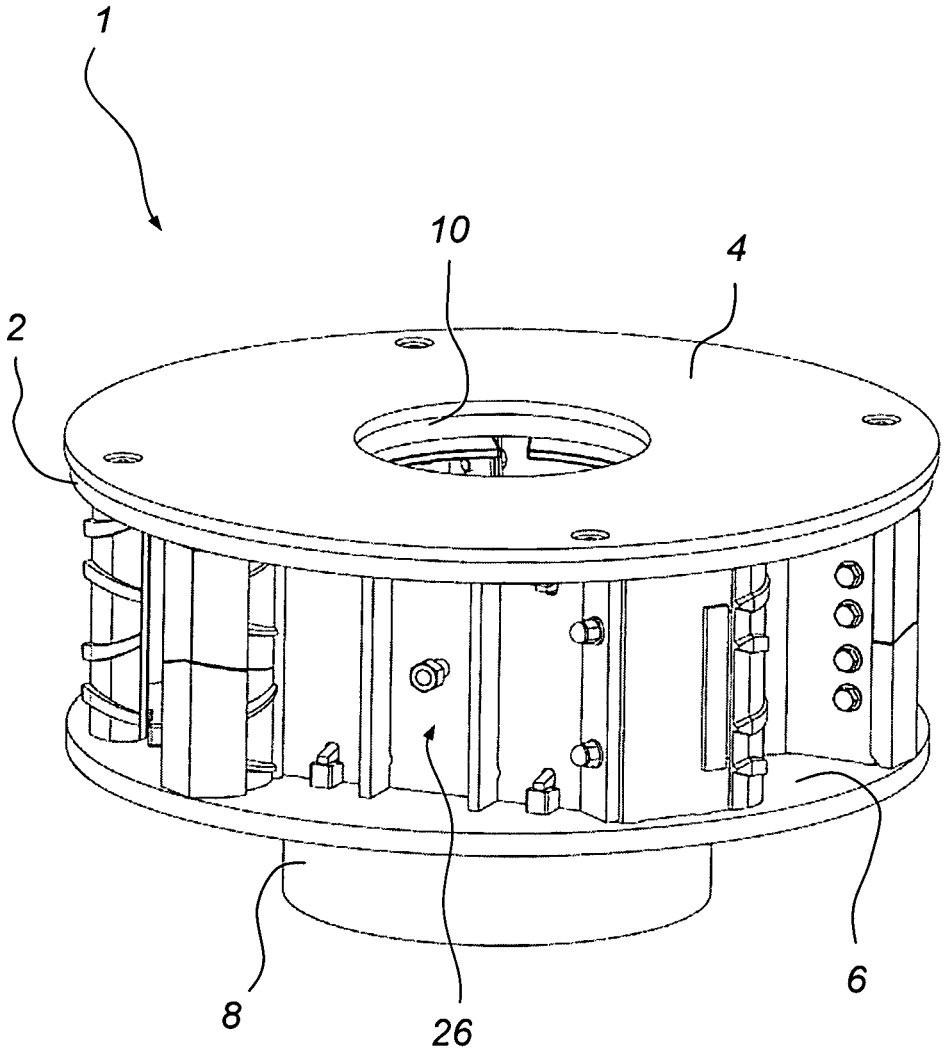
FIG. 1 is a three-dimensional view and shows a rotor for a VSI-crusher.

FIG. 1 shows a rotor 1 for use in a Vertical Shaft Impact crusher, i.e., a VSI-crusher. The rotor 1 has a roof in the form of an upper horizontal disc 2 having a top wear plate 4, and a floor in the form of a lower horizontal disc 6. The lower horizontal disc 6 has a hub 8, which is welded to the disc 6. The hub 8 is to be connected to a vertical shaft (not shown) for rotating the rotor 1 inside the housing of a VSI-crusher. The upper horizontal disc 2 has a central aperture 10 through which material to be crushed can be fed into the rotor 1. The upper horizontal disc 2 is protected from rocks impacting the rotor 1 from above by the top wear plate 4.

Figure 2:
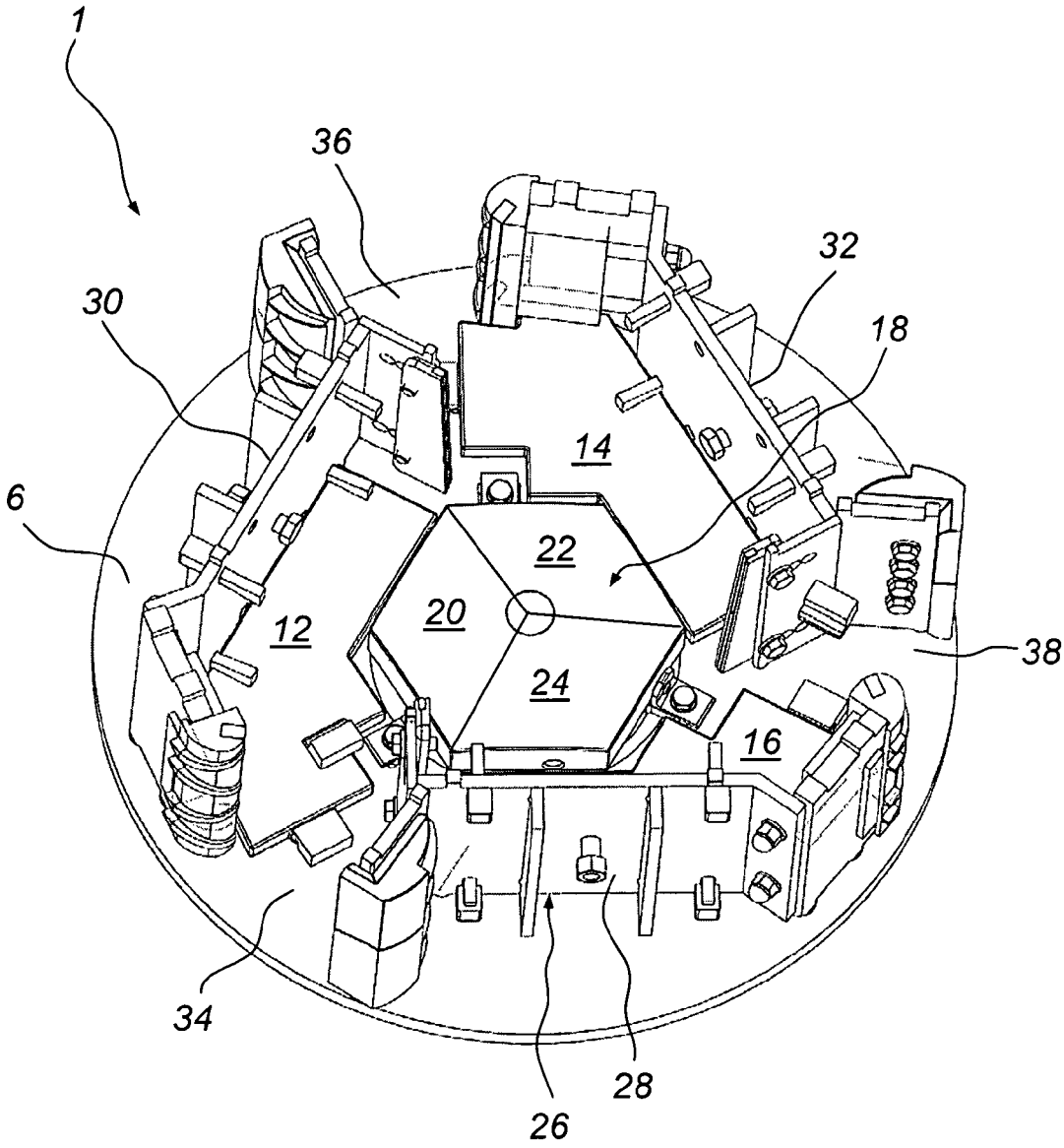
FIG. 2 is a three-dimensional view and shows the rotor of FIG. 1 with the upper disc removed.

As is better shown in FIG. 2, in which the upper horizontal disc 2 and the wear plate 4 are not shown for reasons of clarity, the lower horizontal disc 6 is protected from wear by three lower wear plates 12, 14 and 16. A distributor plate 18 is fastened to the center of the lower horizontal disc 6. The distributor plate 18 distributes the material that is fed via the aperture 10 in the upper horizontal disc 2 and protects the lower horizontal disc 6 from wear and impact damages caused by the material fed via the aperture 10. As will be described in more detail below the distributor plate 18 includes three separate pieces 20, 22, 24. Each of the separate pieces 20, 22, 24 extends from the center of the distributor plate 18 to the periphery thereof, as seen from the top of the distributor plate 18, as is illustrated in FIG. 2.

The upper and lower horizontal discs 2, 6 are separated by and held together by a vertical rotor wall 26, also shown in FIG. 1. The rotor wall 26 is separated into three wall segments 28, 30 and 32 as illustrated in FIG. 2. The gaps between the wall segments 28, 30, 32 define outflow openings 34, 36, 38, through which material may be ejected against a housing wall.

Figure 3:
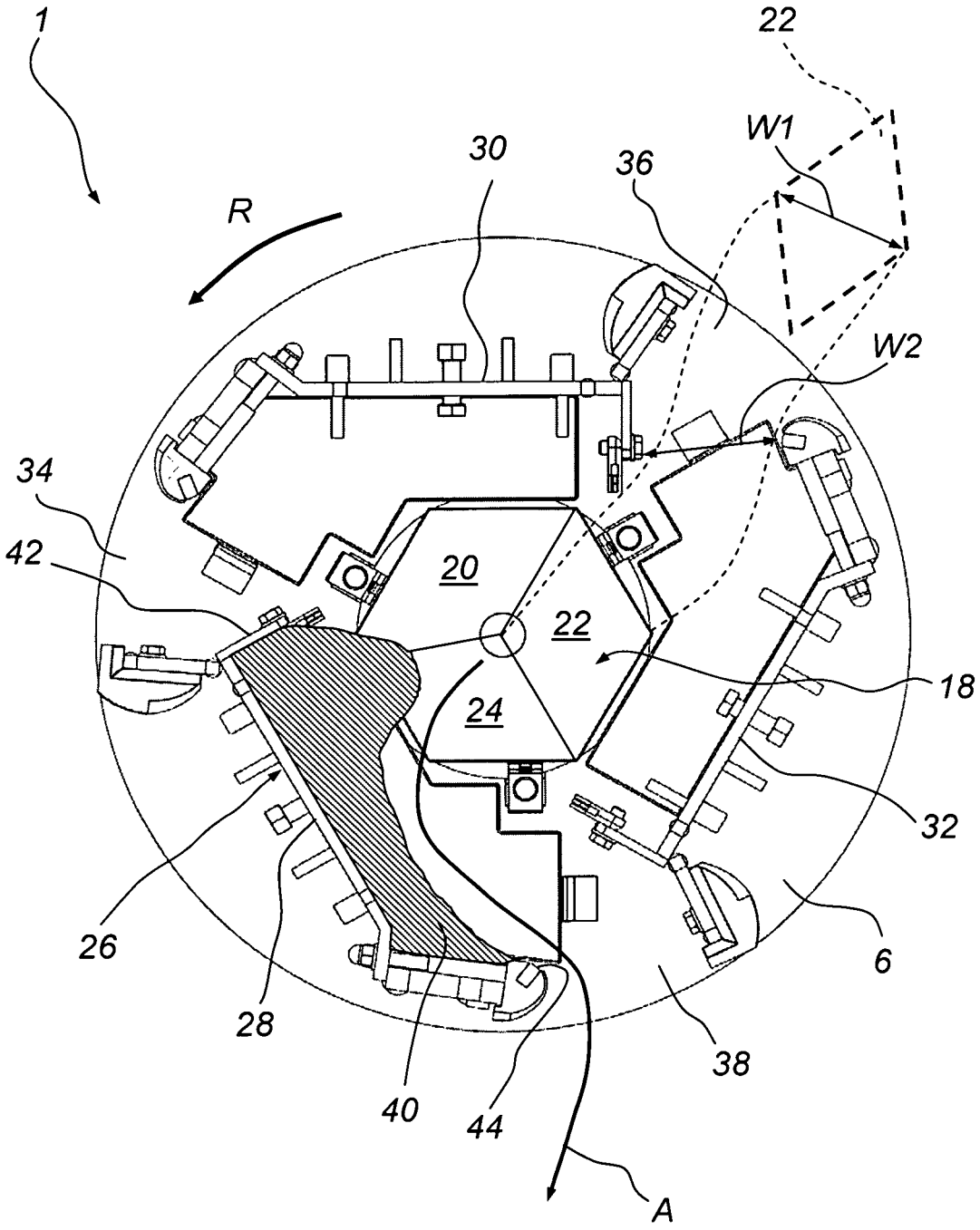
FIG. 3 is a top view of the rotor of FIG. 2 as seen straight from above.

FIG. 3 illustrates the rotor 1 as seen from above and in operation. The upper horizontal disc 2 and the top wear plate 4 are not shown in FIG. 3 for reasons of clarity. The arrow R indicates the rotational direction of the rotor 1 during operation of the VSI-crusher. During operation of the rotor 1, a bed of material 40 is built up inside the rotor 1 against each of the three wall segments 28, 30, 32. In FIG. 3 only the bed 40 located adjacent to the wall segment 28 is shown. The bed 40, which includes material that has been fed to the rotor 1 and then has been trapped inside it, extends from a rear support plate 42 to a wear tip 44. The bed 40 protects the wall segment 28 and the wear tip 44 from wear and provides a proper direction to the ejected material. The arrow A describes a typical passage of a piece of rock fed to the rotor 1 via the central aperture 10 and ejected via the outflow opening 38. It can be seen in FIG. 3 that the arrow A passes, at the distributor plate 18, mainly over the separate piece 24, and not over any separating lines separating the piece 24 from the other separate pieces 20, 22. Thus, the major portion of the flow of material, represented by the arrow A, will flow over the strongest part of the distributor plate 18, and not over the transitions between the separate pieces 20, 22, 24.

It is further illustrated in FIG. 3, by means of broken lines, how a separate piece 22 of the distributor plate 18 may be taken out of the rotor 1, during a maintenance stop, via the outflow opening 36 in the rotor wall 26. This is possible due to the fact that the small width W1 of the separate piece 22 is smaller than the width W2 of the opening 36. It will be appreciated that the separate piece 22 may, in some cases, have to be tilted to get it out of the opening 36. The fact that the distributor plate 18 can be removed from the interior of the rotor 1, or be inserted into the interior of the rotor 1, piece by piece via the openings 34, 36, 38 in the rotor wall 26, makes maintenance easier, since it is not necessary to remove the upper horizontal disc 2 and the top wear plate 4, both of which are only shown in FIG. 1, and/or a material feeding hopper, not shown, to maintain and/or replace one or several of the separate pieces 20, 22, 24 of the distributor plate 18.

Figure 4A:
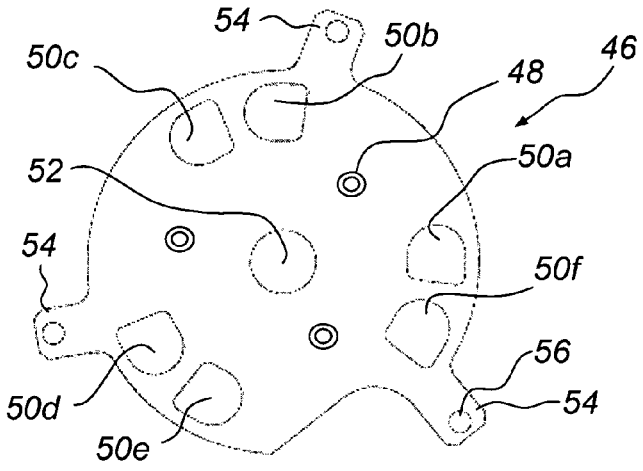
FIG. 4*a* is a top view and illustrates a support plate for a distributor plate.

FIG. 4*a* is a top view of a support plate 46, which is adapted for functioning as a support onto which the distributor plate 18, illustrated in FIG. 2, can be mounted. The support plate 46 is provided with countersunk bolt holes 48 by means of which the support plate 46 is mounted on the hub 8, shown in FIG. 1, via the horizontal lower disc 6. The support plate 46 is normally not a wear part, and thus the support plate 46 is mounted on the horizontal lower disc 6 once and for all. Returning to FIG. 4*a*, the support plate 46 further includes six mounting openings 50*a-f*, each of which forms part of a second portion of a bayonet joint, as will be further described below, and is adapted for cooperating with a corresponding first bayonet joint portion on the distributor plate 18. A central bore 52 is adapted for receiving a central bolt, as will be described below. Furthermore, the support plate 46 includes, evenly distributed around the periphery of the support plate 46, three brackets 54, each of which is provided with a threaded hole 56.

Figure 4B:
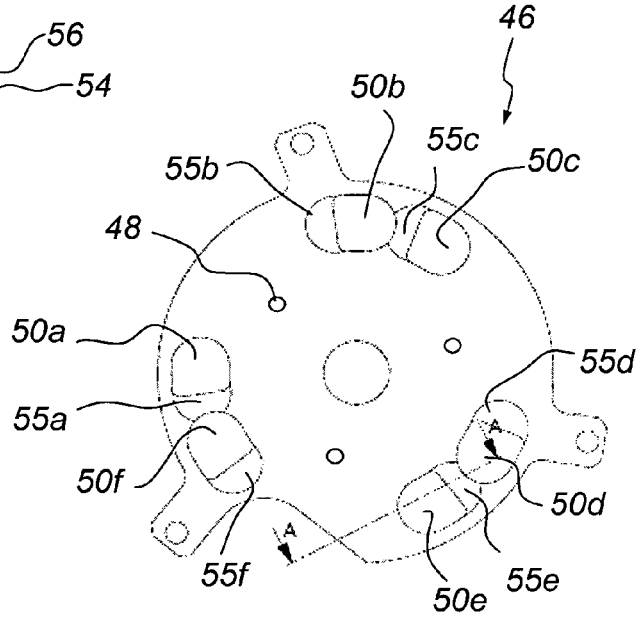
FIG. 4*b* is a bottom view of the support plate of FIG. 4*a*.

FIG. 4*b* is a bottom view of the support plate 46. Adjacent to each mounting opening 50*a-f*, there is a countersunk lower engagement surface 55*a-f*, the function of which will be further illustrated in the following. Each pair including one mounting opening 50*a-f* and one countersunk lower engagement surface 55*a-f* forms a second portion of a bayonet joint; hence, the support plate 46 of FIGS. 4*a-b* is provided with six such second portions a-f.

Figure 4C:
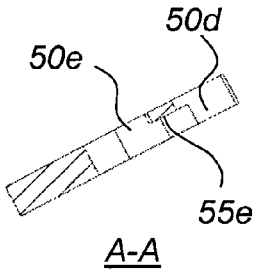
FIG. 4*c* is a cross-section of the support plate, as seen along the line A-A of FIG. 4*b*.

FIG. 4*c* is a view of the section A-A illustrated in FIG. 4*b*; it shows the countersunk engagement surface 55*e*.

Figure 5:
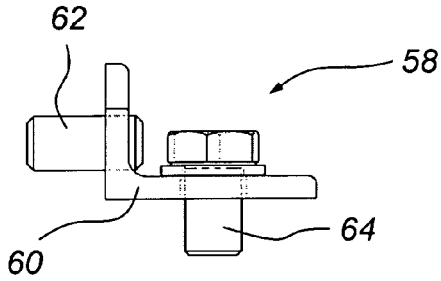
FIG. 5 is a side view of a fastening device.

FIG. 5 illustrates a fastening device 58, the purpose of which will be elucidated below with reference to FIG. 7*a*. The fastening device 58 includes an angle-iron 60, which holds, at its vertical leg, a pin 62. A bolt 64 extends through the horizontal leg of the angle-iron 60. The bolt 64 is adapted for being screwed into the threaded hole 56 of one of the brackets 54, illustrated in FIG. 4*a*, of the support plate 46 to secure the fastening device 58 to the support plate 46.

Figure 6A:
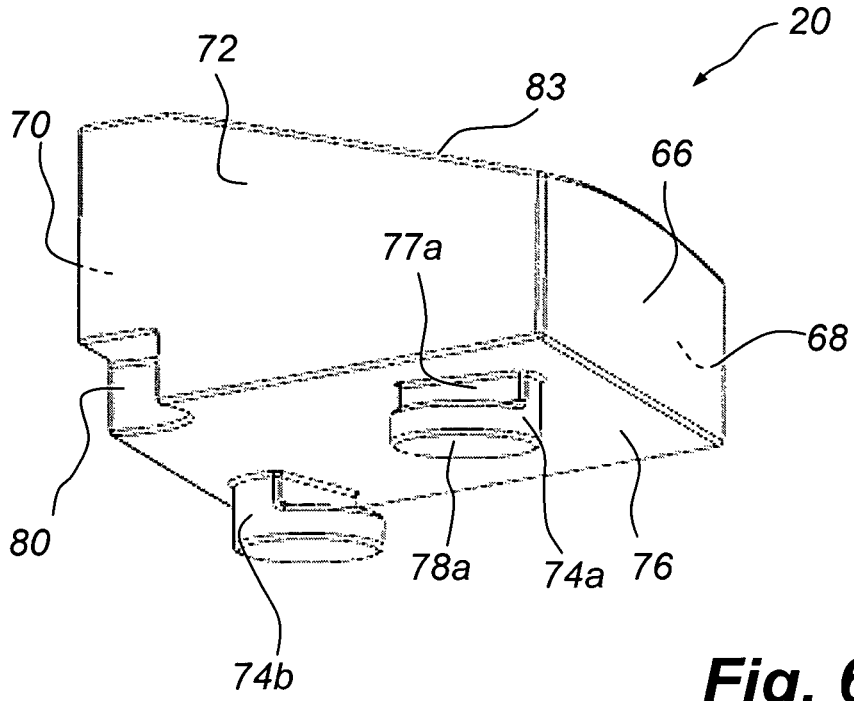
FIG. 6*a* is a three-dimensional view of a separate piece of a distributor plate.

FIG. 6*a* is a view in perspective of the separate distributor plate piece 20. The distributor plate piece 20 includes two outer faces 66, 68, and two inner faces 70, 72. A first foot 74*a*, which forms a first portion of a bayonet joint, extends from a lower face 76 of the separate piece 20. The foot 74*a* has a limit position abutment surface 77*a*, and a circular sole 78*a*, which is small enough to allow the foot 74*a* to be inserted through the opening 50*a* of the support plate 46. The foot 74*a*, together with the mounting opening 50*a* and the lower engagement surface 55*a* form a complete bayonet joint.

A second foot 74*b*, having the same shape as the foot 74*a*, also extends from the lower face 76. Similarly to the foot 74*a*, the foot 74*b* is adapted to be inserted through the opening 50*b* of the support plate 46; hence, the distributor plate piece 20 is provided with two first portions of bayonet joints, to cooperate with two second portions of bayonet joints on the support plate 46. A recess 80, located at the position where the first and second inner faces 70, 72 meet the lower face 76, provides space for the head of a central bolt 88, described hereinafter with reference to FIG. 7*b*, extending through the central bore 52, illustrated in FIG. 4*a*, of the support plate 46. Such a central bolt head may be used for fixing the support plate 46 to the lower disc 6 of the rotor 1, but may also serve as support for the separate distributor plate pieces 20, 22, 24, and/or as an alignment guide, to prevent erroneous orientation of the distributor plate pieces 20, 22, 24 when mounting them onto the support plate 46. The head of the bolt 88 thus forms a central alignment support.

The two feet 74*a-b* both point in a tangential direction with respect to the axis of rotation R of the rotor 1 indicated in FIG. 3.

Figure 6B:
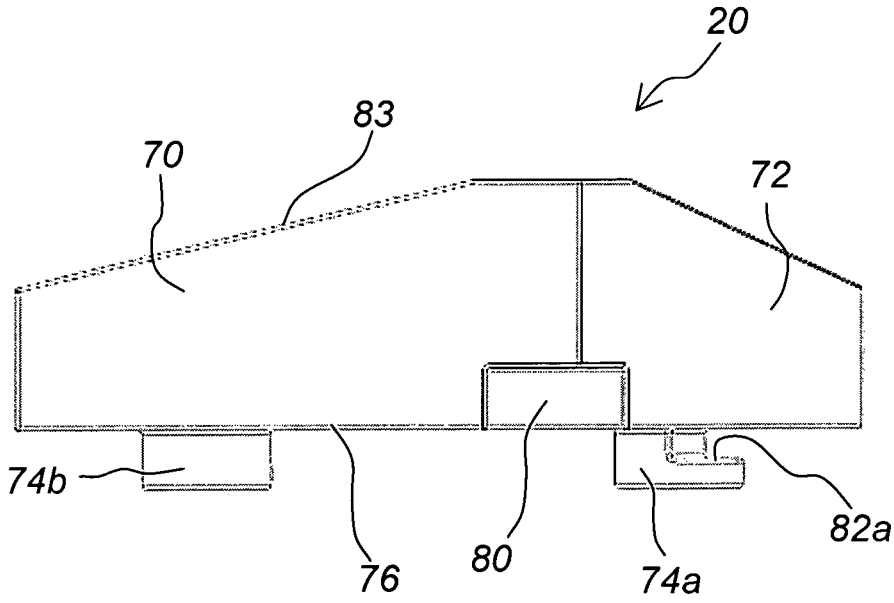
FIG. 6*b* is a plan view of the separate piece of the distributor plate, as seen from the center of the distributor plate.

FIG. 6*b* is a side view that more clearly illustrates the shape of the foot 74*a*, which has an upper engagement surface 82*a*, adapted to engage with the lower engagement surface 55*a* of the support plate 46.

It can further be seen from FIGS. 6*a-b* that an upper surface 83 is slightly sloping upward towards the inner faces 70, 72 of the separate piece 20, and towards the center of the distributor plate 18, illustrated in FIG. 2. This slope is provided for improving the flow of material, as indicated by the arrow A of FIG. 3, from the center of the rotor 1 towards the outflow openings 34, 36, 38.

In FIGS. 6*a-b* the separate piece 20 of the distributor plate 18 has been described. The separate pieces 22 and 24 of the distributor plate 18 have identical design as the separate piece 20, such that one type of separate piece can be used in any location of the distributor plate 18.

FIG. 7*a* illustrates the distributor plate 18, as made up of separate distributor plate pieces 20, 22, 24, after having been mounted on the support plate 46. It will be appreciated that the support plate 46 is fixed to the horizontal lower disc 6, which is not shown in FIGS. 7*a-b* and FIGS. 8*a-b* for clarity reasons. A central vertical bolt 88 illustrated in FIG. 7*b* has been mounted in the central bore 52 of the support plate 46. The head 89, indicated with dashed lines in FIG. 7*a*, of the bolt 88 is located in the recess 80 shown in FIGS. 6*a* and 6*b*. The distributor plate pieces 20, 22, 24 are held in place in such a manner that they cannot move in relation to one another or in relation to the support plate 46.

In FIGS. 7*a-b*, each of the three identical distributor plate pieces 20, 22, 24 are located in such a position on the support plate 46 that each foot 74*a-f* extends into its corresponding mounting opening 50*a-f* of the support plate 46, and engages a respective engagement surface 55*a-f* illustrated in FIG. 4*b*. This engagement locks the distributor plate pieces 20, 22, 24 vertically, and also prevents the distributor plate pieces 20, 22, 24 from sliding radially, as well as clockwise as seen from above, across the support plate 46. In order to prevent counter-clockwise sliding of the distributor plate pieces 20, 22, 24 across the support plate 46, the crusher may be operated such that the rotor 1 is rotated counter-clockwise, as is illustrated in FIG. 3. Rocks to be crushed, which are falling down onto the distributor plate 18 from above, will thereby exert a resulting friction force on the distributor plate 18, the friction force acting clockwise, as seen from above in FIG. 7*a*, on the distributor plate 18, and forcing the distributor plate pieces 20, 22, 24 into their locked positions.

A supplementary first fastening device 58*a*, of the fastening device type 58 illustrated in FIG. 5, has been mounted on the support plate 46 in such a manner that its pin 62, shown in FIG. 5, extends into a pin hole of the separate distributor plate piece 24. The bolt 64, shown more clearly in FIG. 5, of the fastening device 58*a* secures the fastening device 58*a* to the support plate 46. Second and third fastening devices 58*b-c*, which are identical to the fastening device 58*a*, fix the separate distributor plate pieces 20, 22 to the support plate 46.

The fastening devices 58*a-c* support and improve the locking of the distributor plate pieces 20, 22, 24 onto the support plate 46, but they are optional, and are not necessary for securely fixing the distributor plate pieces 20, 22, 24 to the support plate 46. When the crusher is in operation, the friction between rocks to be crushed and the distributor plate 18, and between the support plate 46 and the distributor plate 18, is sufficient to keep the distributor plate pieces 20, 22, 24 in place.

Figure 8A:
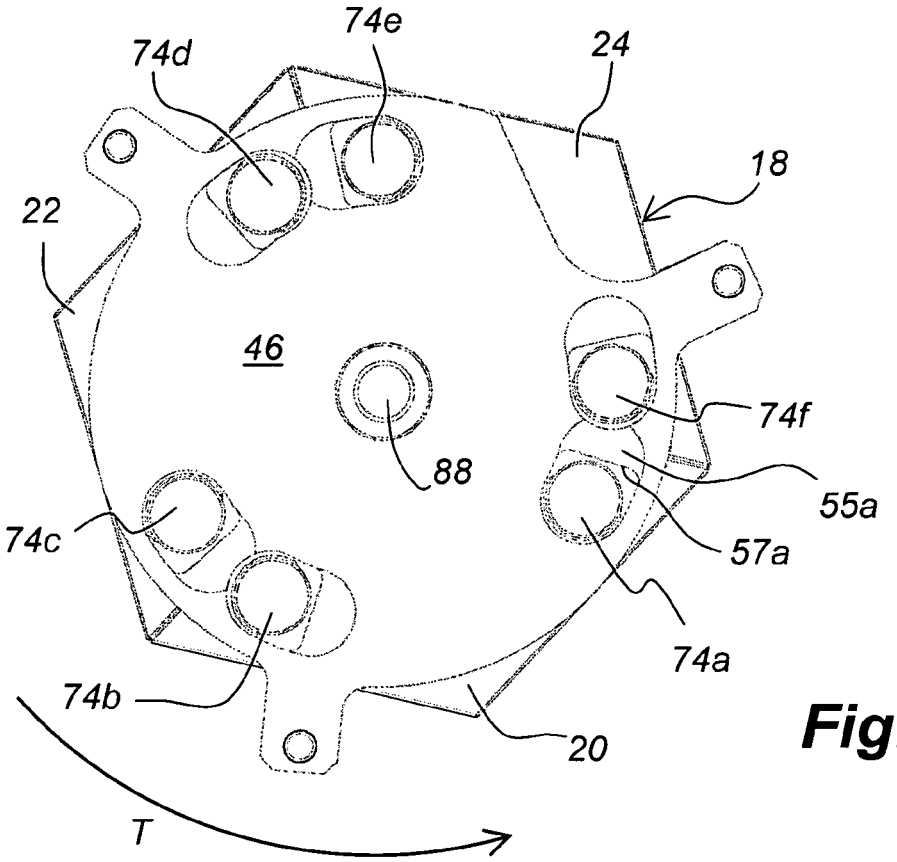
FIG. 8*a* is a bottom view of the complete distributor plate and support plate, in an intermediate, unlocked position.
Figure 8B:
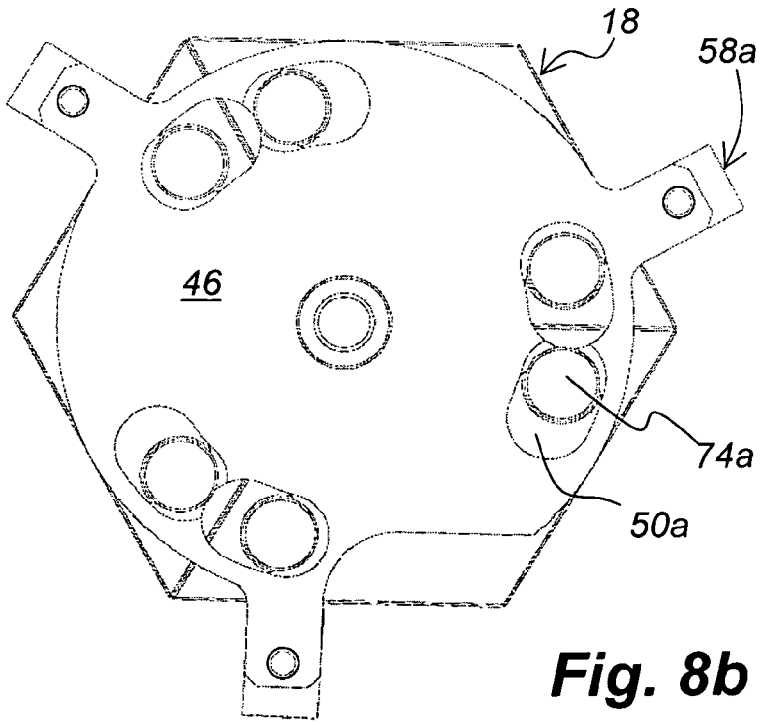
FIG. 8*b* is a bottom view of the complete distributor plate and support plate, in a final, locked position.

FIGS. 8*a-b* illustrate, as seen from below, the manner in which the distributor plate 18 can be attached to the support plate 46. First, the distributor plate pieces 20, 22, 24 are introduced into the rotor. Such introduction into the rotor could be made in the manner described hereinbefore with reference to FIG. 3, i.e., by moving the pieces 20, 22, 24 horizontally into the rotor 1 via an outflow opening 36. As alternative, the pieces 20, 22, 24 could be introduced into the rotor 1 via the top thereof. The distributor plate pieces 20, 22, 24 are held above the support plate 46, and are then lowered vertically downwards, such that the feet 74*a-f* of the distributor plate pieces 20, 22, 24 penetrate the mounting openings 50*a-f* of the support plate 46. This will bring the distributor plate 18 and the support plate 46 to the intermediate, unlocked position illustrated in FIG. 8*a*.

Thereafter, the distributor plate 18, i.e., the separate pieces 20, 22, 24, is twisted in relation to the support plate 46 about a vertical axis, which in this example coincides with the axis of symmetry of the bolt 88. The distributor plate 18 is twisted counter-clockwise, as seen from below in FIG. 8*a*, and as is illustrated by an arrow T, to a limit position. This will bring the distributor plate 18 and the support plate 46 to the final, locked position illustrated in FIG. 8*b*, in which the upper engagement surface 82*a-f*, illustrated in FIG. 6*b*, of each foot 74*a-f* engages a respective countersunk, lower engagement surface 55*a-f*, illustrated in FIGS. 4*b* and *c*, of the support plate 46.

In this example, the limit position is a mechanical stop defined by the abutment of the limit position abutment surface 77*a*, illustrated in FIG. 6*a*, of the foot 74*a* against the edge 57*a*, illustrated in FIG. 8*a*, of the countersunk engagement surface 55*a*. In the example shown in FIGS. 8*a-b*, after twisting the distributor plate 18, also the other feet 74*b-f* will abut against corresponding edges of the engagement surfaces 55*b-f*.

Finally, after the distributor plate pieces 20, 22, 24 have been located properly on the support plate 46, and twisted about the vertical axis to a limit position, the fastening devices 58*a-c* are mounted on the support plate 46 in the manner described hereinbefore.

In order to remove the distributor plate, e.g., for replacement or service, the above procedure is followed in reverse order.

Above, it has been described that the distributor plate is hexagonal and includes three separate pieces. It will be appreciated that a hexagonal distributor plate could, as alternative, be formed as a single, integral piece, or could be divided in any other suitable number of pieces. Furthermore, the distributor plate need not be hexagonal at all; it is also possible to design triangular, square, pentagonal, hexagonal, octagonal, and nonagonal distributor plates, each including one or more separate pieces and being designed in accordance with the above described principles. It is also possible, but often less preferred, to design a distributor plate which has a circular design.

Above, countersunk engagement surfaces 55*a-f* have been described. However, the surfaces need not be countersunk; for example, the feet 74*a-f* may instead engage with the bottom surface of the support plate 46 or with the lower disc 6.

Above, it has been described that the distributor plate 18 is mounted on a support plate 46 which is mounted on the lower horizontal disc 6. Hence, the distributor plate 18 is mounted indirectly on the lower horizontal disc 6. It will be appreciated that, as alternative, the distributor plate 18 can be mounted directly on the lower horizontal disc. Alternatively, the support plate may also be provided with fastening means corresponding to those associated with distributor plates of prior art, and thereby serve as an interface between a support plate or lower rotor disc of prior art, and a distributor plate of the present invention. In this manner, the distributor plate of the present invention may be offered also as a retrofit for existing VSI crushers designed in accordance with the prior art.

Above, it has been illustrated that the feet 74*a-b* on the separate piece 20 form two first portions of two bayonet joints, and that mounting openings 50*a-b* with lower engagement surfaces 55*a-b* on the support plate 46 form second portions of those bayonet joints. In accordance with an alternative embodiment an upper engagement surface, forming a first portion of a bayonet joint, could be formed in a recess in the lower face of a distributor plate piece, or along the periphery of that piece, and could be adapted for cooperating with a lower engagement surface, forming a second portion of that bayonet joint and being formed on a foot protruding from the upper surface of the support plate, or along its periphery, for cooperating with the lower engagement surface of the distributor plate piece. Hence, the distributor plate piece could be provided with either a foot or an opening at its lower face, or a combination of both.

Furthermore, it will also be appreciated that other types of bayonet joints could be used for holding a separate piece on the support plate, for example bayonet joints including structures on the periphery of the distributor plate, like those joints generally found on camera lenses or BNC connectors for electrical radio-frequency cables.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A method of mounting a replaceable distributor plate on a lower horizontal disc of a rotor of a vertical shaft impact crusher for protecting said lower horizontal disc, comprising:

vertically moving the distributor plate in place; and twisting the distributor plate to a limit position, wherein the vertical shaft impact crusher comprises the rotor having an upper horizontal disc and the lower horizontal disc, the rotor including the distributor plate having a first portion of a bayonet joint, said first portion being adapted for cooperating with a second portion of said bayonet joint, said second portion being associated with the lower horizontal disc, and said first portion of the bayonet joint being adapted to be twisted to the limit position in a joint direction that is opposite to a crushing operation rotation direction of the rotor.

2. A vertical shaft impact crusher, comprising:

a rotor having an upper horizontal disc and a lower horizontal disc, said rotor including a distributor plate including a first portion of a bayonet joint, said first portion being adapted for cooperating with a second portion of said bayonet joint, said second portion being associated with the lower horizontal disc, said first portion of the bayonet joint being adapted to be twisted in a joint direction that is opposite to a crushing operation rotation direction of the rotor.

3. The vertical shaft impact crusher according to claim 2, wherein the first portion of the bayonet joint includes a foot, the foot pointing in a tangential direction with respect to an axis of rotation of the rotor.

4. The vertical shaft impact crusher according to claim 2, wherein the first portion of the bayonet joint is adapted to be twisted to a limit position, the limit position being a mechanical stop that prevents further twisting in the joint direction.

5. The vertical shaft impact crusher according to claim 2, wherein said first portion of the bayonet joint is located on a bottom surface of the distributor plate.

6. The vertical shaft impact crusher according to claim 2, wherein said first portion of the bayonet joint is a foot, an upper engagement surface of the foot being adapted to engage with a lower engagement surface associated with the lower horizontal disc.

7. The vertical shaft impact crusher according to claim 2, wherein said distributor plate comprises 2 to 6 separate pieces, each piece comprising a first portion of a bayonet joint.

8. The vertical shaft impact crusher according to claim 7, wherein each of said separate pieces extends from the center of the distributor plate to the periphery thereof, as seen from the top of the distributor plate.

9. The vertical shaft impact crusher according to claim 2, the distributor plate further comprising a recess for a central alignment support.

* * * * *